United States Patent [19]

Ecker et al.

[11] Patent Number: 4,694,552

[45] Date of Patent: Sep. 22, 1987

[54] METHOD FOR FABRICATING A COMPOUND PORTAL FRAME EXTRUSION PROFILE

[75] Inventors: Warren S. Ecker, Delray Beach, Fla.; Howard J. Ecker, Hartsdale; Robert S. Ecker, New York, both of N.Y.; Maurice E. Sterner, Jr., Spring Grove, Pa.

[73] Assignees: Ecker Mfg. Corp., New York, N.Y.; Product Design & Development, Inc., York, Pa.

[21] Appl. No.: 901,415

[22] Filed: Aug. 28, 1986

[51] Int. Cl.[4] ..... E04G 21/00; E04C 2/26

[52] U.S. Cl. ..... 29/418; 29/509; 29/515; 49/504; 49/DIG. 1; 52/731

[58] Field of Search ..... 29/418, 509, 515, 243.5; 49/504, DIG. 1; 52/98, 731

[56] References Cited

U.S. PATENT DOCUMENTS

| | | | |
|---|---|---|---|
| 3,204,324 | 9/1965 | Nilsen | 49/DIG. 1 |
| 3,423,897 | 1/1969 | Birum, Jr. | 49/504 |
| 3,487,518 | 1/1970 | Hopfeld | 29/515 |
| 3,562,992 | 2/1971 | Kinsey | 52/731 |
| 3,798,869 | 3/1974 | Nipp | 49/DIG. 1 |
| 3,992,769 | 11/1976 | Jackson | 29/418 |

*Primary Examiner*—P. W. Echols

*Attorney, Agent, or Firm*—Samuel M. Learned, Jr.

[57] ABSTRACT

A compound portal frame extrusion profile of that type employed in the manufacture of insulated portal frames for windows or sliding doors and the like, wherein the compound portal frame profile is fabricated by means of a cooperative mechanical clamp assembly structure provided integral to a set of separate lineal portal frame profile extrusion components and a fabrication method is employed based on the utilization thereof which enables the interim lineally aligned interlock connection of the separate portal frame profile extrusion components, in turn being of either two dissimilar colors or materials or a combination thereof respectively for the interiorly and exteriorly outward facing finished compound portal frame extrusion profile component members, to thus form an intercommunicating resin receiving trough for containing and supporting the progressive injection deposit therewithin of a thermally non-conductive resin-bonding material by which is formed a structural interlock connection joinably between the two separate lineal portal frame profile extrusion components to thereby produce the compound portal frame extrusion profile, wherein thereafter upon a lineal removal of a portion of a sidewall of the previously formed resin receiving containment trough to in turn form a continuously extending lineal gap in the trough sidewall of the structural interlock connection it then also functions as an interposed thermal cavity barrier to substantially reduce differential heat transfer between the interiorly outward facing and exteriorly outward facing joined portal frame extrusion profile component members when the finished compound portal frame extrusion profile hereof is applied in window or sliding door portal frame use.

6 Claims, 10 Drawing Figures

METHOD FOR FABRICATING A COMPOUND PORTAL FRAME EXTRUSION PROFILE

BACKGROUND OF THE INVENTION

This invention relates to a framing material for the finishing of portal openings in building structures, such as that used for window and sliding door frames and the like, and particularly to a new and novel clamping structure and method based thereon for fabricating a compound portal frame profile comprised of two separate lineal portal frame profile extrusion components wherein one such component is for the interiorly outward facing member and the other for the exteriorly outward facing member and further wherein the respective members may be of different colors for facilitated color harmony coordination with the planned or existing interior and exterior building structure color schemes, or different materials of composition for design coordination and optimum weathering features, or a combination thereof for multiple design and economy advantages, said components being joined one to the other by means of a resin-bonded structural interlock connection which forms a thermal cavity barrier to substantially reduce differential heat transfer across the finished compound portal frame extrusion profile member from the building structure conditioned interior ambient atmosphere to the building structure natural exterior ambient atmosphere.

Various compound portal frame profile structures are known in the prior art, such as that shown in FIG. 1 and as more particularly taught in U.S. Pat. No. 3,204,324 to Nilsen dated Sept. 7, 1965, wherein a single profile member 10 which is of the same material composition throughout and initially of the same color, is provided with a trough 12 adapted to receive a resin-bonding insulating material 14, afterwhich profile material 16 is removed by milling or otherwise from the trough bottom sidewall surface 18 as indicated to provide a downward disposed non-conductive thermal void 20 cooperative with the upward disposed previously extruded thermal void 22, thus forming a compound portal frame extrusion profile 10' comprised of an interiorly outward facing member 24 and an exteriorly outward facing member 26 both of the same color and material of composition being structurally joined one to the other by the resin-bonding insulating material 14. If it is desired to make the members 24 and 26 different colors, it then becomes necessary to perform separate and additional painting operations.

A true structurally interlock connected dissimilar material compound portal frame extrusion profile 28 is also known in the prior art, as more particularly taught in U.S. Pat. No. 3,798,869 to Nipp dated Mar. 26, 1974, and as is illustrated in FIG. 2, wherein a first lineal portal frame profile extrusion component 30 which is a metal alloy material of a particular color provides the interiorly outward facing member of the compound portal frame extrusion profile 28, and a second lineal portal frame profile extrusion component 32 which is a plastic material of another color provides the exteriorly outward facing member of the compound portal frame extrusion profile 28, the two being assembled one to the other in lineally aligned interim connection by means of plastic component snap-lock protrusions 34 resilient engagement within metal alloy component recesses 36, thereby forming an enclosed thermal-gap void which is thereafter filled through sidewall opening 38 with a resin-bonding insulating material 14. It will be noted, however, that by use of a plastic extrusion component 32 it also becomes necessary to provide a second metal alloy facing member 40 in combination therewith, as shown in FIG. 2, in order to enhance the structural character thereof.

Another prior art practice which provides an interlock connected dissimilar material compound portal frame extrusion profile 42 is as shown in FIG. 3, wherein a first and second separate lineal portal frame profile extrusion component 44 and 46 respectively the interiorly and exteriorly facing members thereof, are joined one to the other by snap-lock engagement with a plastic extrusion profile 48. It is to be noted, however, that this particular snap-lock engagement profile does not per se provide a portal framing material of true structural rigidity.

With the increased trend to pre-manufactured structures, for everything from domestic to commercial, industrial, and institutional buildings, and with the evolution of pre-manufactured structures which incorporate design features to enhance appearance while at the same time holding the line on costs, there is in turn a growing market and need for economically produced structurally interlock connected dissimilar material compound portal frame extrusion profiles with the incorporated thermal cavity feature to substantially eliminate differential heat transfer between the interiorly outward facing and the exteriorly outward facing joined portal frame extrusion profile component members. In addition to the pre-manufactured structural application, there is also the retrofit application for replacement portal frames in older building structures, as well as also application in new building structure construction.

The FIG. 4 illustration shows a cross-sectional view of the instant invention compound portal frame extrusion profile 50, which meets the existing and evolving needs of the application markets therefor as above-recited, while at the same time enabling high rates of production with minimum waste and employing a fabrication method which enhances production economies, all as hereinafter are more particularly described in detail.

SUMMARY OF THE INVENTION

It is the principal object of the present invention to provide a cooperative structure and method for fabrication which enables the production of a compound portal frame profile assembled with dissimilar materials respectively for the interiorly and exteriorly outward facing portal frame members thereof.

It is another object of the present invention to provide interior and exterior portal frame members having cooperative mechanical clamp assembly components which function in a joined and roll-crimped configuration as an interim compound lineal alignment and connecting means during fabrication operations whereby an intercommunicating resin receiving trough is formed for support and containment of a thermally non-conductive resin-bonding material by which in turn is formed a structural interlock connection joinably between said profile members.

An additional object of the present invention is to provide a compound portal frame profile wherein the structural interlock joining said profile members forms and functions as a thermal cavity barrier to substantially reduce differential heat transfer between the interiorly outward facing and the exteriorly outward facing joined portal frame extrusion profile component members of the finished compound window frame profile fabrication.

It is another object of the present invention to provide an economical and efficient method of fabricating a compound portal frame profile of the type herein taught wherein the interior and exterior portal frame profile members may be of different colors.

It is a further object of the present invention to provide an economical and efficient method of fabricating a compound portal frame profile of the type herein taught wherein the interior and exterior portal frame members may be of different metallic alloy materials.

Still another object of the present invention is to provide an economical and efficient method of fabricating a compound portal frame profile of the type herein taught wherein the interior and exterior portal frame profile members may be comprised one of a metallic alloy material and the other of a structural non-metallic material.

It is also an object of the present invention to provide a compound portal frame cooperative structure, and a method of fabrication, which enables the utilization of the features thereof in accommodating both efficient and low cost mass production manufacturing machinery and standard assembly techniques.

DETAILED DESCRIPTION OF THE INVENTION

It is to be understood that the instant invention relates to a compound portal frame extrusion profile, so denominated because it is comprised of the lineal thermal insulative resin bonding of two separate laterally spaced portal frame extrusion profile components which may be of different color or materials of composition or a combination thereof, wherein the design configuration of the respective separate portal frame extrusion profile lineal components as herein shown are to be regarded as exemplary only so long, however, as each is provided with the specific cooperative mechanical clamp assembly structures of the instant invention so they may in turn be connectably assembled for resin bonded structural joining of one to the other by mechanism of the method herein taught.

Figure 1:
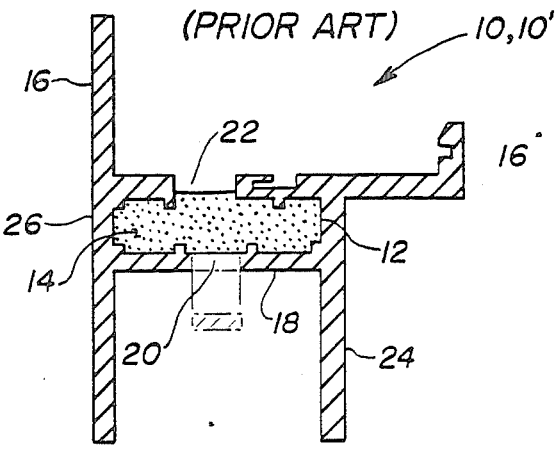
Fig. 1 (PRIOR ART)
FIGS. 1 through 3 are various cross-sectional views illustrating typical prior art compound portal frame profiles.
Figure 2:
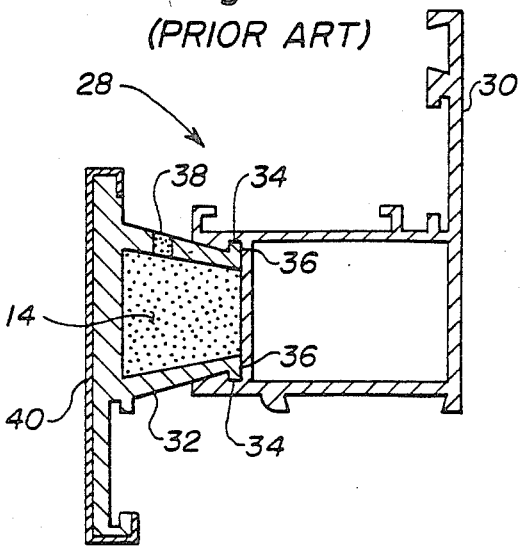
Fig. 2 (PRIOR ART)
Figure 3:
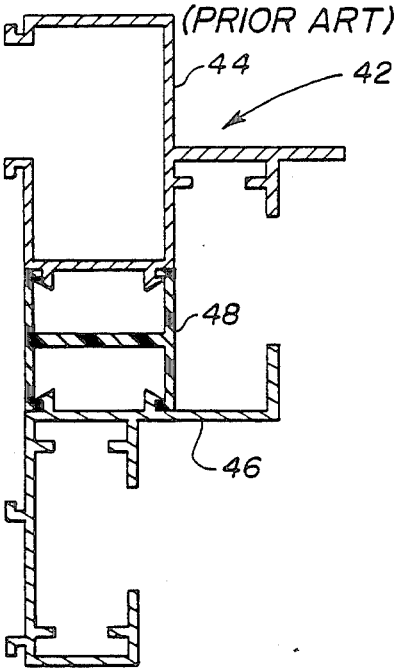
Fig. 3 (PRIOR ART)

The prior art methods of forming typical compound portal frame extrusion profiles, and some of the relative structural and feature limitations respectively thereof, have already been described and discussed on previous consideration of FIGS. 1 through 3 hereof.

Figure 4:
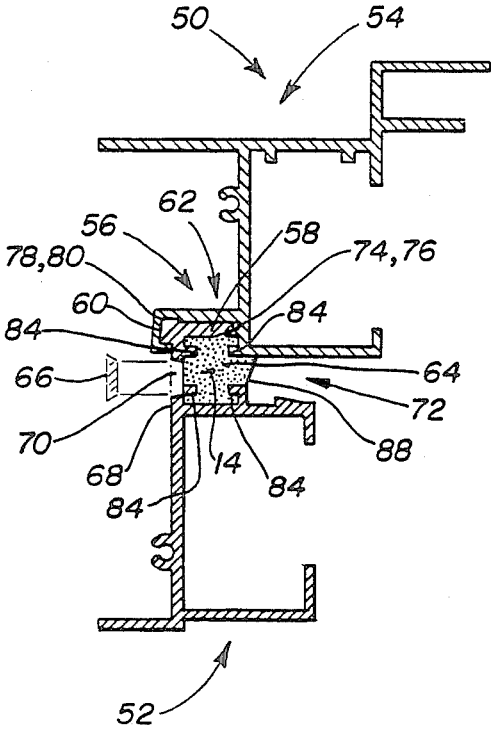
FIG. 4 is a cross-sectional view illustrating a compound portal frame profile according to the present invention.

Considering in detail now FIG. 4, wherein is illustrated a cross-sectional view of the instant invention compound portal frame extrusion profile 50, having as the major structural elements thereof a first separate portal frame extrusion profile component 52 being for purposes of description and discussion the building structure interiorly outward facing portal frame member, a second separate portal frame extrusion profile component 54 which for purposes of description and discussion herein being the building structure externally outward facing portal frame member, respectively provided with cooperative mechanical clamp assembly 56 components being a connection flange member 58 shaped to be receivably positioned and roll-crimp secured within a cooperative connection flange recess 60 to form an interim connecting means 62 and also provides an intercommunicating resin-receiving U-shaped trough 64 within which is deposited a suitable resin-bonding insulating material 14, all of which in cooperative mechanical combination upon removal of a continuously extending lineal strip 66 from the trough bottom sidewall 68 to provide a lineally extending thermal cavity barrier gap 70 comprises the interposed thermally non-conductive resin-bonding structural interlock connection 72 between the first and second separate portal frame extension profile components 52 and 54 and by which is fabricated the compound portal frame extrusion profile 50 of instant invention. The main advantage derived from the method of fabrication as herein taught for forming the compound portal frame extrusion profile 50 is that the separate and distinct character respectively of the first and second separate portal frame extrusion profile components 52 and 54, whether it be in the form of different colors, materials of composition, textural finishes, or a separate and distinct combination of all such distinguishing features, does not control or create fabrication limitations with materials of construction in the metals, metal alloy, plastics, and structural synthetics classes, and once the interposed thermally non-conductive resin-bonding structural interlock connection 72 is formed there is no further need or necessity for additional manufacturing or processing operations in the production of a true structurally sound and thermally insulative lineal as provided by the compound portal frame extrusion profile 50 of instant invention.

Figure 5:
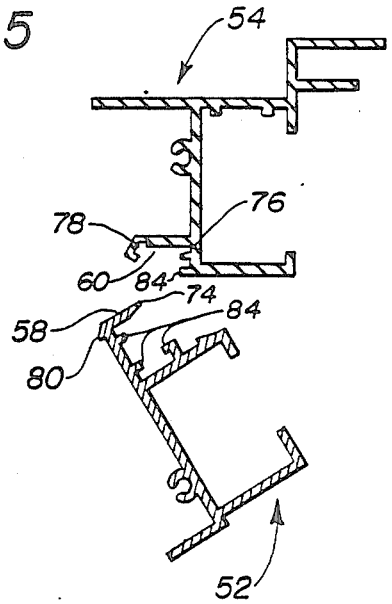
FIGS. 5 through 10 are cross-sectional views illustrating that series of steps of the instant invention method by which is fabricated the compound portal frame profile according thereto.

Considering now the FIG. 5 through FIG. 10 series of illustrations, which depict the sequential step-wise method of fabricating a compound portal frame extrusion profile 50, and discussing first FIG. 5. The FIG. 5 illustration shows two typical lineal extrusion profiles wherein the interiorly outward facing member of the compound portal frame to be fabricated is shown as the first separate portal frame extrusion profile component 52 and the exteriorly outward facing member thereof is shown as the second separate portal frame extrusion profile component 54, wherein the distinctively different cross-hatching renditions respectively thereof are not to represent any particular materials of construction, but rather to show a difference distinction therebetween whether it be a difference of color or composition or finish or a multiple combination in differences thereof.

It will be noted in FIG. 5 that the first and second extrusion profile components 52 and 54 are positioned in a detached and spaced relationship one with respect to the other, oriented so that the connection flange member 58 of said first extrusion profile component 52 is readied for manipulative insertion of the connection flange nose 74 to within the connection flange nose receiving recess 76 portion of the cooperative connection flange recess 60 of said second extrusion profile component 54. The manner of accomplishing the oriented positioning of said first and second extrusion profile components 52 and 54 as illustrated in FIG. 5 may be by either manual or mechanical means, or a combination thereof. It will also be noted in FIG. 5 that the crimp retention recess 78 portion of the cooperative connection flange recess 60, positioned in a web-connected longitudinal spaced relationship with respect to the nose receiving recess 76, is disposed in a flex-extended open position for facilitated receivable mechanically cooperative positioning with respect thereto of the crimp lug protrusion 80 of the connection flange member 58, it being positioned in a web-connected longitudinal spaced relationship with respect to the connection flange nose 74, wherein the respective mechanically cooperative geometric configurations overall of the connection flange member 58 and the cooperative connection flange recess 60 are male-female profiles.

Figure 6:
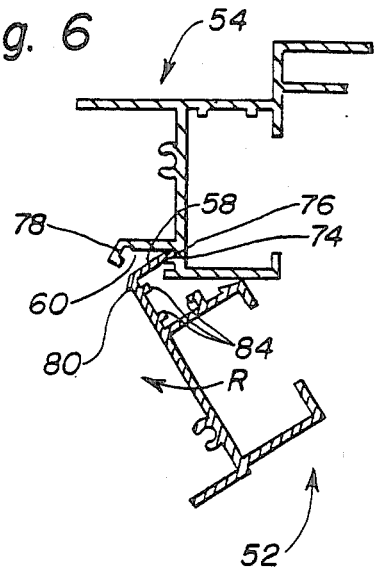
Figure 7:
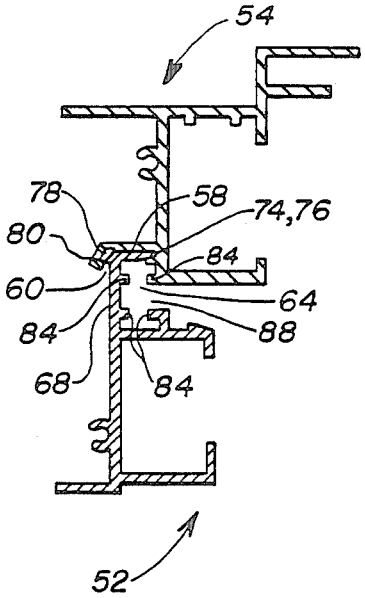

The view shown in FIG. 6 illustrates the receivable positioning placement of the connection flange nose 74 of the first extrusion profile component 52 within the connection flange nose receiving recess 76 of the second extrusion profile component 54, again accomplished by suitable manual or mechanical means or a combination thereof. When the respective extrusion profile component 52 and 54 lineally aligned receivable placement of the nose 74 within the nose receiving recess 76 as above described and illustrated in FIG. 6 is accomplished, the first separate portal frame extrusion profile component 52 is then rotated in the direction of Arrow R with respect to the stationarily retained second separate portal frame extrusion profile component 54 so that the connection flange nose 74 is pivotally inserted within the connection flange nose receiving recess 76 therefor for male-female mechanically cooperative engagement therewithin and the crimp lug protrusion 80 of the first extrusion profile component 52 is thereupon positioned and aligned for crimp-retained engagement thereof within the crimp retention recess 78 of the second extrusion profile component 54. The insertable male-female mechanically cooperative placement positioning of the connection flange member 58 within the cooperative connection flange recess 60 and the position alignment of the crimp lug protrusion 80 with the crimp retention recess 78 as above described is as shown in FIG. 7. It will be noted that the interim connecting means 62 by which the first and second separate portal frame extrusion profile components 52 and 54 are mechanically joined one to the other for continued fabrication operations is not accomplished until the crimping operation is completed as shown in FIG. 8.

Figure 8:
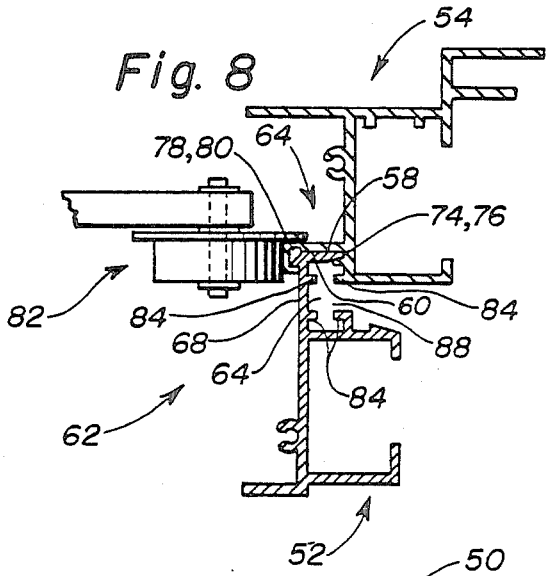

The view shown in FIG. 8 illustrates the next stepwise compound portal frame extrusion profile fabrication procedure, being the completion of conformed pivotal deflection engagement of the crimp retention recess 78 portion from the flex-extended open position disposition as initially shown in FIG. 5 to the closed crimp retention position accomplished by means of a suitable roll-crimp device 82, whereupon is formed the interim connecting means 62 and the intercommunicating resin-receiving U-shaped trough 64. The view shown in FIG. 8 is that configuration whereby the interim connecting means 62 comprised of the roll-crimped retention of the connection flange member 58 within the cooperative connection flange recess 60 provides a lineally aligned and mechanically stablized interim joining of the first and second separate portal frame extrusion profile components 52 and 54, and further thereby provides the intercommunicating resin-receiving U-shaped trough 64 structure having resin interlock lugs 84 which in cooperative mechanical combination with a deposited and cured resin-bonding insulating material 14 functions so as to effect a true structural joining of the respective profile components 52 and 54.

Figure 9:
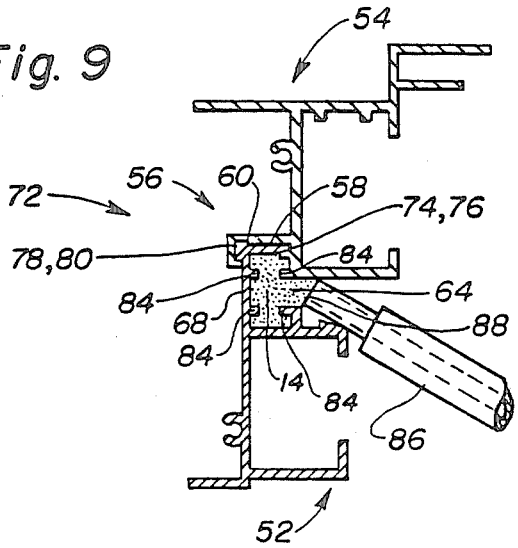

The view shown in FIG. 9 illustrates the resin-bonding step of the compound portal frame extrusion profile fabrication method as herein taught, which is accomplished by the directed resin injection gun 86 injected deposit of a resin-bonding insulating material 14 within the intercommunicating resin-receiving U-shaped trough 64 through the open end 88 thereof, whereby said resin bonding insulating material 14 in cooperative mechanical interlock with said resin interlock lugs 84 and the previously completed interim connecting means 62 of said first and second separate portal frame extrusion profile components 52 and 54, effects a true structural joining of one to the other by the resultantly formed interposed thermally non-conductive resin-bonding structural interlock connection 72.

Figure 10:
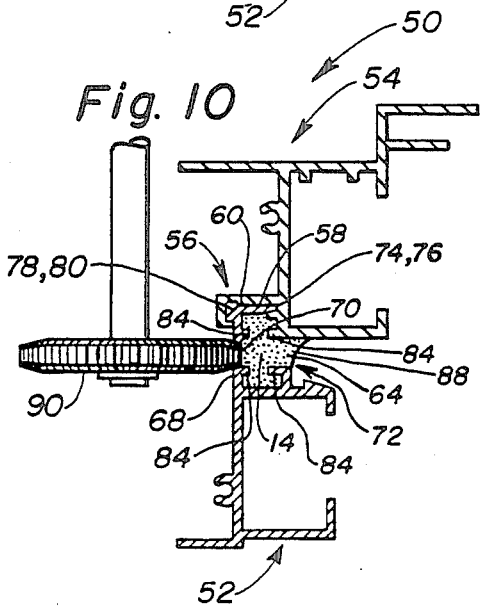

Since there is close contact conformity of the first and second separate portal frame extrusion profile components 52 and 54 at the interim connecting means 62, which would allow for conductive heat loss transfer thereacross between said extrusion profile components 52 and 54 being respectively the building structure interiorly outward facing and exteriorly outward facing compound portal frame extrusion profile members, the view shown in FIG. 10 illustrates the final fabrication step to provide insulative features which is that of removing a strip of the trough bottom sidewall 68 by means of an appropriate cutting tool 90, down to the point of exposing the resin-bonding insulating material 14 and thus provide a lineally extending thermal cavity barrier gap 70 from end-to-end longitudinally of said compound portal frame extrusion profile, thereby enhancing the thermal insulative qualities thereof by breaking the aforementioned thermally conductive conduit and having the only points of common structural communication between said first and second separate portal frame extrusion profile components 52 and 54 across the interposed thermally non-conductive resin-bonding structural interlock connection 72. Again, FIG. 4 as previously described also shows detail of the foregoing insulative structural connection as well as that of the finished fabrication detail of the compound portal frame extrusion profile 50 of instant invention.

Although the compound portal frame extrusion profile invention hereof, the structural connection means for accomplishing fabrication thereof, and the method of fabrication therefor, respectively have been shown and described in what are conceived to be the most practical and preferred embodiments, it is recognized that departures may be made respectively therefrom within the scope of the invention, which is not to be limited per se to those specific details as disclosed herein but is to be accorded the full scope of the claims so as to embrace any and all equivalent devices, apparatus, and methods.

We claim:

1. A method of fabricating a compound portal frame extrusion profile, comprising the steps of lineally aligning a first separate portal frame extrusion profile component in a detached and spaced relationship with respect to a second separate portal frame extrusion portal frame extrusion profile component, pivotally inserting a connection flange nose of a connection flange member of said first extrusion profile component within a connection flange nose receiving recess of a cooperative connection flange recess of said second extrusion profile component so that said connection flange member is pivotally received in lineal alignment within said cooperative connection flange recess in an insertable male-female mechanically cooperative positioning placement and thereby lineally positions a crimp lug protrusion of said first extrusion profile component adjacent a flex-extended crimp retention recess of said second extrusion profile component, accomplishing progressive lineal roll crimp conformed pivotal deflection engagement of said crimp retention recess from a flex-extended open position disposition to receivably engage said crimp lug protrusion in a closed crimp retention position to thereby effect an interim connecting means between said first and second extrusion profile components and form a lineally disposed intercommunicating U-shaped resin-receiving trough structure therebetween, injection depositing a resin-bonding insulating material within said lineally disposed intercommunicating U-shaped resin receiving trough structure from end-to-end longitudinally thereof, and thereafter cuttably removing a strip from a sidewall of said U-shaped resin-receiving trough down to the resin-bonding insulating contained therewithin to thereby provide a lineally extending thermal cavity barrier gap from end-to-end longitudinally of the compound portal frame extrusion profile thus formed.

2. The method of fabricating a compound portal frame extrusion profile according to claim 1 wherein said first extrusion profile component is a first color and said second extrusion profile component is a second color.

3. The method of fabricating a compound portal frame extrusion profile according to claim 2 wherein said first extrusion profile component is a first material of composition and said second extrusion profile component is a second material of composition.

4. The method of fabricating a compound portal frame extrusion profile according to claim 3 wherein said first extrusion profile component is provided with a first textural finish and said second extrusion profile component is provided with a second textural finish.

5. The method of fabricating a compound portal frame extrusion profile according to claim 1 wherein said first extrusion profile component is a first material of composition and said second extrusion profile component is a second material of composition.

6. The method of fabricating a compound portal frame extrusion profile according to claim 1 wherein said first extrusion profile component is provided with a first textural finish and said second extrusion profile component is provided with a second textural finish.

* * * * *